United States Patent [19]

Cillario

[11] 4,453,640

[45] Jun. 12, 1984

[54] ADJUSTABLE, SECTIONAL DISPLAY DEVICE

[75] Inventor: Lorenzo Cillario, Alba, Italy

[73] Assignee: Ferrero S.p.A., Alba, Italy

[21] Appl. No.: 408,917

[22] Filed: Aug. 17, 1982

[30] Foreign Application Priority Data

Feb. 1, 1982 [IT] Italy ..... 52859/81[U]

[51] Int. Cl.[3] ..... A47F 3/14

[52] U.S. Cl. ..... 211/133; 211/126; 211/43; 211/194

[58] Field of Search ..... 211/133, 128, 205, 186, 211/126, 51, 43, 175, 194

[56] References Cited

U.S. PATENT DOCUMENTS

| | | | |
|---|---|---|---|
| 2,545,844 | 3/1951 | Cougias | 211/51 X |
| 2,959,293 | 11/1960 | Von Meyer | 211/43 X |
| 3,028,014 | 4/1962 | Southwick | 211/51 X |
| 3,051,319 | 8/1962 | Glaser | 211/133 |
| 3,141,557 | 7/1964 | Marschak | 248/165 X |
| 3,244,128 | 4/1966 | Rogalski et al. | 211/133 X |
| 3,800,958 | 4/1974 | Dorn | 211/43 |

FOREIGN PATENT DOCUMENTS

| | | | |
|---|---|---|---|
| 2019456 | 11/1971 | Fed. Rep. of Germany | 211/205 |
| 2019457 | 11/1971 | Fed. Rep. of Germany | 211/205 |

*Primary Examiner*—Ramon S. Britts
*Assistant Examiner*—Blair M. Johnson
*Attorney, Agent, or Firm*—Bernard, Rothwell & Brown

[57] ABSTRACT

A modular display stand is constructed from a plurality of vertically-connectable, tubular sections extending upwardly from a carriage which supports the lower-most tubular section. The connected sections are topped with a placard holder connectable to the upper-most section. Each tubular section has shelves cantilevered on either sides thereof via support rods, and each shelf has spring-biased movable side walls to accommodate materials of different dimensions.

4 Claims, 7 Drawing Figures

ADJUSTABLE, SECTIONAL DISPLAY DEVICE

The present invention relates to display devices, and is particularly concerned with a display device comprising a pillar and a plurality of shelves supported by the pillar and distributed along the length of the pillar.

The display device according to the invention is characterised in that the pillar is constituted by a plurality of consecutive tubular sections coupled together in a releasably engageable manner, and in that the shelves are arranged in pairs each of which comprises shelves cantilevered on opposite sides of one of the tubular sections of the pillar.

By virtue of this characteristic, the display device according to the invention has a modular structure and offers considerable convenience and efficiency in use, particularly for displaying food products packed in trays.

The advantages resulting from the invention will become clear from the description given below, purely by way of non-limiting example, with reference to the appended drawings, in which.

Figure 1:
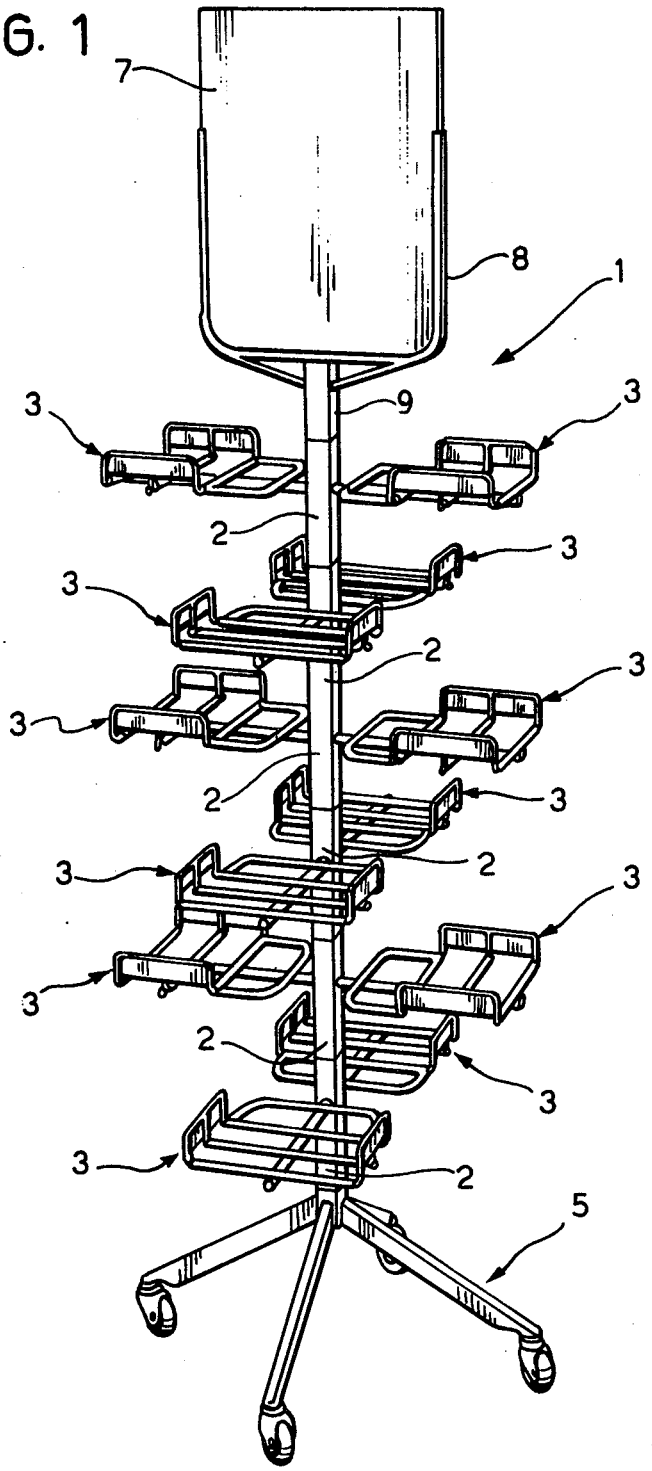
FIG. 1 is a perspective view of a display device according to the invention.
Figure 2:
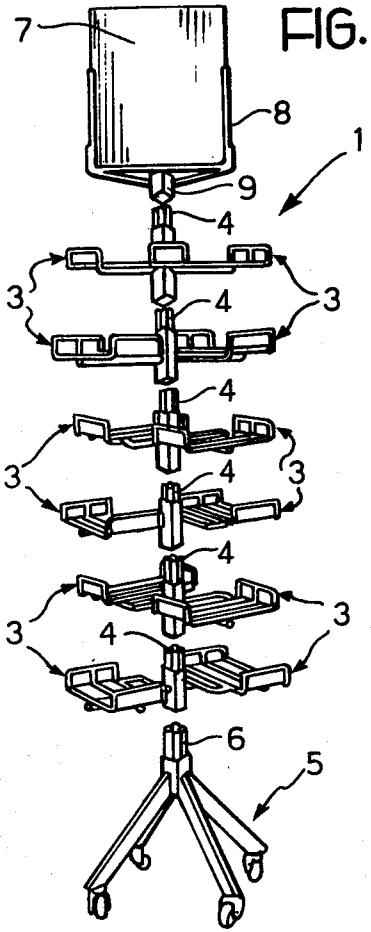
FIG. 2 is an exploded perspective view substantially similar to FIG. 1, illustrating the modular nature of the display device of FIG. 1.
Figure 4:
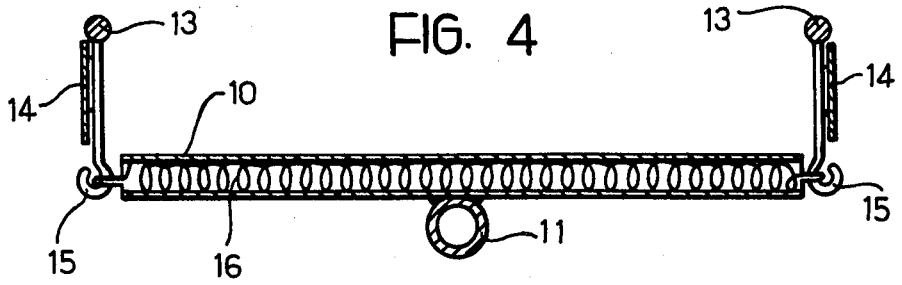
FIG. 4 is a section taken on the line IV—IV of FIG. 3.
Figure 5:
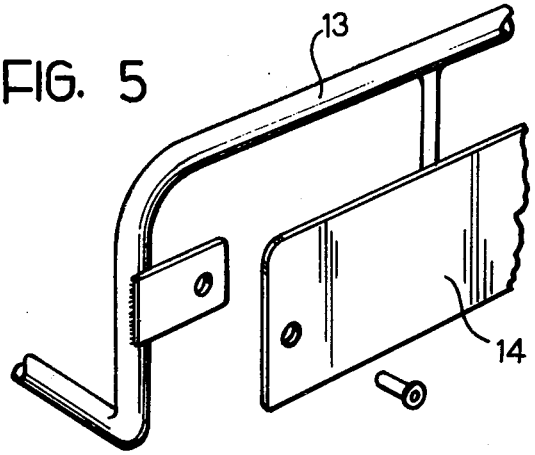
FIG. 5 is a view on arrow V of FIG. 3.

In FIGS. 1 and 2, a display device, generally indicated 1, comprises a central pillar formed by a number of tubular sections 2 each carrying a pair of shelves 3.

Figure 3:
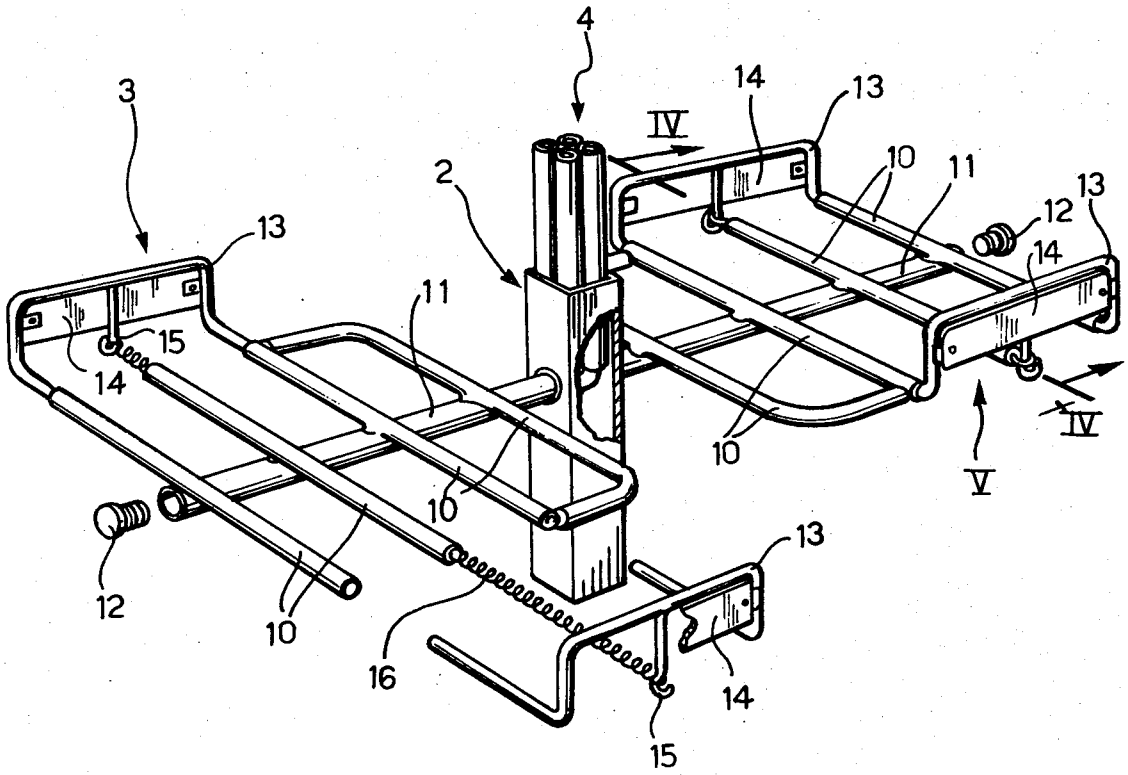
FIG. 3 is a partially-exploded and cut away perspective view, on an enlarged scale, of one of the elements illustrated in FIGS. 1 and 2.

As best seen in FIG. 3, each tubular section 2 is in the form of a prismatic box-shaped body within which are fixed, for example, by welding, four pieces of cylindrical bar which extend from the prismatic body to form a spigot 4 engageable in the lower cavity of another tubular section 2 in the mode of assembly illustrated schematically in FIG. 2.

In this mode of assembly, the engagement between the consecutive tubular sections is such that the direction of mutual alignment of the shelves 3 carried by each section 2 is at right angles to the direction of mutual alignment of the shelves 3 carried by the adjacent tubular sections 2.

In the drawings, a carriage, generally indicated 5, comprises four legs each of which carries a wheel at one end and is connected at the other end to a central tubular body with a vertically projecting spigot 6 substantially identical to the spigots 4 of the tubular sections 2 of the pillar.

The spigot 6 may thus be engaged in the lower cavity of the tubular section 2 carrying the two lowermost shelves 3 so that the carriage 5, as well as rendering the display device movable, supports the pillar in a vertical position.

At the upper end of the pillar is a placard 7 intended, for example, to carry advertisements or other information about the product displayed on the shelves 3.

The placard 7 is supported by a fork element 8 having a channel-section open towards the interior of the fork.

The element 8 is provided with a tubular appendage 9 which is engaged on the spigot 4 of the tubular section 2 carrying the two uppermost shelves 3.

As illustrated on an enlarged scale in FIG. 3, each of the shelves 3 is constituted by an array of tubes 10 which extend horizontally in a direction perpendicular to a support rod 11 to which they are welded.

The support rod 11 passes horizontally through the prismatic body of the respective tubular section 2 to which it is welded.

The rod 11 has an axial cavity which is closed by end plugs 12.

Two side walls, each comprising a frame 13 to which a flat part 14 is fixed, for example, by riveting, are associated with each shelf 3.

The frame 13 is formed from a piece of cylindrical bar bent so that the ends of the piece form two arms freely slidable within corresponding tubes 10, while the intermediate part of the piece forms an arcuate part which surrounds the flat part 14.

The arrangement is such that the walls of each shelf 3 are movable towards each other to vary the capacity of the shelf.

Preferably, the walls of each shelf also have eyelet parts 15 each of which is connected to one end of a helical spring 16 extending through one of the tubes 10 to draw the opposing walls of each shelf back to the position in which they are closest together.

Figure 6:
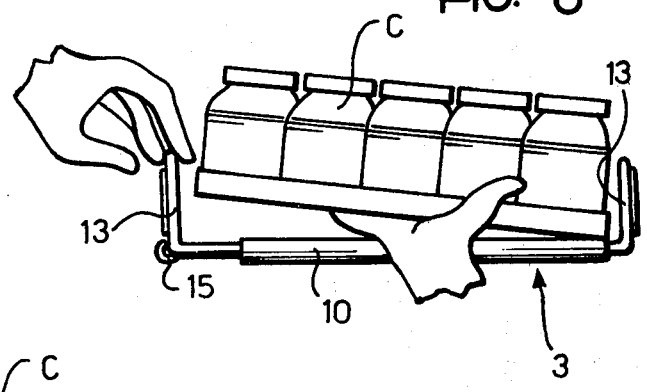
FIGS. 6, 7 illustrate schematically the use of a display device according to the invention for displaying food products packed in trays.
Figure 7:
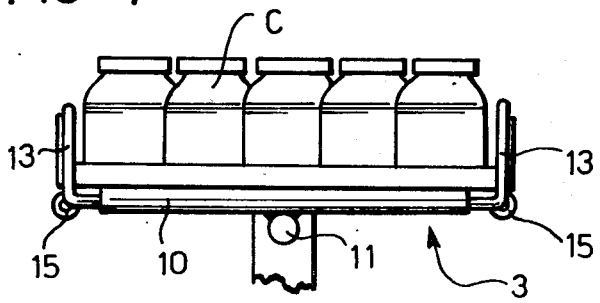

FIGS. 6 and 7 illustrate the use of one of the shelves 3 for displaying a product.

In the embodiment illustrated, the product to be displayed, generally indicated C, is constituted by a plurality of jars in a rectangular dished container of folded cardboard or expanded polystyrene, usually called a tray.

In order to place a tray containing the packed product C on one of the shelves 3 of the display device, it suffices to force the walls of the shelf apart. This may be achieved, as illustrated schematically in FIG. 6, by pushing normally on at least one of the walls to cause the tubular arms of the frame of the wall to slide in the corresponding tubes 10.

As soon as the tray has been placed on the shelf 3, the wall may be released so that it is drawn back to a position of engagement with the respective side of the tray (FIG. 7) by the action of spring 16.

The shelf structure described adapts easily to trays of different dimensions, since the distance between the walls of each shelf is adjusted automatically to the distance between the two opposite sides of the tray.

The return action exerted by the spring 16 also effects clamping of the tray between the walls. The tray is thus secured against falling due to accidental collisions.

Preferably, the flat parts 14 of the walls of the shelves 3 face outwardly of the container so as to be able to carry advertising, prices, and other visual information on the product displaced.

Naturally, the effects of the present invention also extend to models which achieve equal utility by using the same innovative concept.

What is claimed is:

1. A display device comprising a pillar and plurality of shelves supported by the pillar at intervals along the length thereof, wherein the pillar is constituted by a plurality of tubular sections which are coupled together releasably, and the shelves are arranged in mutually aligned pairs on respective said sections of the pillar, the shelves of each pair being cantilevered on opposite sides of the respective section, wherein each pair of shelves includes a horizontal support rod which passes through the respective tubular section; two arrays of tubes which extend perpendicular to the support rod and define the respective base planes of the said shelves, and two side walls attached to each shelf, the side walls having arms freely slidable within the said tubes so that the walls of each shelf are movable relative to each other to vary the capacity of the shelf.

2. A display device as defined in claim 1, wherein it further includes means for resiliently biassing the side walls of each shelf towards a position in which they are closest together.

3. A display device as defined in claim 1, wherein the side walls include flat parts facing outwardly of the respective shelves.

4. A modular display device, comprising;

(a) a plurality of tubular sections, each section having means for interconnecting with an adjacent section so that the plurality of interconnected sections form a column;

(b) a pair of shelves for each section, the shelves extending from opposite sides of each section and attached to a support rod extending through the tubular section;

(c) the means for interconnecting the sections maintaining the shelves of adjacent sections perpendicular to each other;

(d) a support carriage having means for interconnecting to the bottom of the interconnected tubular sections;

(e) a placard-carrying element having means for interconnecting to the top of the interconnected tubular sections; and (f) each shelf having end members and means for adjustably positioning the end members to accommodate loads of different dimensions on the shelves.

* * * * *